US010188143B2

(12) United States Patent
Fath et al.

(10) Patent No.: US 10,188,143 B2
(45) Date of Patent: Jan. 29, 2019

(54) DISPLAY PACKAGES, BLANKS FOR FORMING TRAP SEAL CARD AND BLANK FOR FORMING DISPLAY BOX

(71) Applicant: Altria Client Services LLC, Richmond, VA (US)

(72) Inventors: Scott. A. Fath, Richmond, VA (US); William J. Bogdziewicz, III, Richmond, VA (US); Robert T. Mitten, Glen Allen, VA (US); Ryan Alan Bailey, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 119 days.

(21) Appl. No.: 14/998,021

(22) Filed: Apr. 17, 2015

(65) Prior Publication Data

US 2017/0008683 A1 Jan. 12, 2017

(51) Int. Cl.
*B65D 71/00* (2006.01)
*A24F 47/00* (2006.01)
(Continued)

(52) U.S. Cl.
CPC ..... *A24F 47/008* (2013.01); *A24F 15/00* (2013.01); *B65D 75/367* (2013.01); *B65D 75/54* (2013.01);
(Continued)

(58) Field of Classification Search
CPC ..... B65D 75/367; B65D 75/54; B65D 2575/367; B65D 73/0092; B65D 73/0057; B65D 75/522; A24F 15/00; A24F 47/008
(Continued)

(56) References Cited

U.S. PATENT DOCUMENTS 2,913,101 A 11/1959 Daily
3,338,400 A 8/1967 Raymond
(Continued)

FOREIGN PATENT DOCUMENTS

GB 2088829 A 6/1982
KR 2012-0003872 U 6/2012
(Continued)

OTHER PUBLICATIONS

Partial International Search Report for International Application No. PCT/US2016/027200 dated Jun. 23, 2016.
(Continued)

*Primary Examiner* — Luan K Bui
(74) *Attorney, Agent, or Firm* — Harness, Dickey & Pierce, P.L.C.

(57) ABSTRACT

Display packages include a packaging including a cavity for holding an item, and a trap seal card including a first opening. The trap seal card retains the packaging such that the item held within the cavity is visible to a consumer through the first opening, and a portion of the packaging protrudes through the first opening. The trap seal card includes a front panel integral with a back panel. The packaging is between the front panel and the back panel. Blanks for the trap seal card include the back panel or the front panel having a first length and a second length less than the first length. The first and second lengths extend in a perpendicular direction to a first fold line. Blanks for the display box include a tab detachable from a remaining portion of the back panel when the back panel is separated along a ninth fold line.

8 Claims, 10 Drawing Sheets

(51) Int. Cl.

| | |
|---|---|
| ***B65D 75/36*** | (2006.01) |
| ***B65D 75/54*** | (2006.01) |
| ***A24F 15/00*** | (2006.01) |
| ***B65D 85/10*** | (2006.01) |

(52) U.S. Cl.
CPC ..... *B65D 85/10* (2013.01); *B65D 2575/367* (2013.01)

(58) Field of Classification Search
USPC ..... 206/461–463, 466, 467, 469, 471, 532, 206/539, 223, 722, 723, 776, 777, 779, 206/780
See application file for complete search history.

(56) References Cited

U.S. PATENT DOCUMENTS

| | | | | |
|---|---|---|---|---|
| 3,762,545 | A * | 10/1973 | Warner | B65D 75/36 206/459.5 |
| 4,125,190 | A * | 11/1978 | Davie, Jr. | B32B 3/28 206/462 |
| 4,180,165 | A | 12/1979 | Kuchenbecker | |
| D263,561 | S | 3/1982 | Wong | |
| 4,549,654 | A | 10/1985 | Tiesman | |
| 4,804,984 | A | 2/1989 | Heuer et al. | |
| 4,958,731 | A | 9/1990 | Calcerano | |
| 5,060,814 | A | 10/1991 | Oglesbee | |
| D324,651 | S | 3/1992 | Kaneko | |
| 5,275,291 | A * | 1/1994 | Sledge | B65D 43/20 206/532 |
| 5,392,919 | A | 2/1995 | Passamoni | |
| D417,391 | S | 12/1999 | Szczepanski et al. | |
| D440,489 | S | 4/2001 | Igami et al. | |
| 6,298,995 | B1 | 10/2001 | Schwester | |
| 6,308,832 | B1 * | 10/2001 | Pirro | B65D 73/0092 206/462 |
| 6,588,596 | B1 | 7/2003 | Holmes et al. | |
| D495,249 | S | 8/2004 | Martinson et al. | |
| 6,779,566 | B2 | 8/2004 | Engel | |
| 6,920,980 | B2 | 7/2005 | Hwang et al. | |
| D510,262 | S | 10/2005 | Isono et al. | |
| 6,951,282 | B2 * | 10/2005 | Jones | B65D 75/367 206/469 |
| D584,138 | S | 1/2009 | Lafortezza et al. | |
| 7,533,744 | B2 | 5/2009 | Mack | |
| 7,621,405 | B2 * | 11/2009 | Schweitzer | B65D 73/0092 206/463 |
| 7,650,997 | B2 | 1/2010 | Nago | |
| 8,006,834 | B2 | 8/2011 | Marcinkowski | |
| D660,723 | S | 5/2012 | Akana et al. | |
| D692,615 | S | 10/2013 | Verleur | |
| D700,048 | S | 2/2014 | Bloch et al. | |
| D712,090 | S | 8/2014 | Liu | |
| D712,748 | S | 9/2014 | Akana et al. | |
| D713,738 | S | 9/2014 | Akana et al. | |
| D713,739 | S | 9/2014 | Akana et al. | |
| D713,740 | S | 9/2014 | Akana et al. | |
| D727,497 | S | 4/2015 | Yang et al. | |
| D736,077 | S | 8/2015 | Moskovich et al. | |
| D748,498 | S | 2/2016 | Pipes et al. | |
| 9,290,291 | B2 | 3/2016 | Hamdoun et al. | |
| D768,008 | S | 10/2016 | Akana et al. | |
| 9,492,006 | B2 | 11/2016 | Jimenez et al. | |
| 9,527,643 | B2 | 12/2016 | Streich et al. | |
| 2005/0183981 | A1 * | 8/2005 | Gelardi | B65D 83/0463 206/531 |
| 2006/0231447 | A1 | 10/2006 | Fensham | |
| 2008/0314791 | A1 | 12/2008 | Schweitzer et al. | |
| 2009/0285436 | A1 | 11/2009 | Lowry | |
| 2011/0147241 | A1 | 6/2011 | Marcinkowski | |
| 2011/0278192 | A1 * | 11/2011 | Thornton | B65D 73/0092 206/471 |
| 2013/0146489 | A1 | 6/2013 | Scatterday | |
| 2014/0209497 | A1 | 7/2014 | Jacobus | |
| 2014/0216970 | A1 * | 8/2014 | Mattiucci | B65D 73/0092 206/471 |
| 2014/0262931 | A1 | 9/2014 | Fath | |
| 2015/0008149 | A1 | 1/2015 | Liu | |
| 2015/0375893 | A1 | 12/2015 | Korinek | |
| 2016/0264297 | A1 | 9/2016 | Cernokus et al. | |
| 2017/0008683 | A1 | 1/2017 | Fath et al. | |
| 2017/0060262 | A1 | 3/2017 | Hviid et al. | |

FOREIGN PATENT DOCUMENTS

| | | | |
|---|---|---|---|
| WO | WO-2005/054078 | A1 | 6/2005 |
| WO | WO-2015/015156 | A1 | 2/2015 |

OTHER PUBLICATIONS

E-cigarette blister pack eGo-K vivi nova starter kit 650mah/900mah/1100mah, ShenZhen, 2016, http://www.alibaba.com/product-detail/E-cigarette-blister-pack-eGo-K_721390903.html?s=p.

New design pen style electronic cigarette Mini eGo-B black rubberized finish e-cigarette blister pack, ShenZhen, 2016, http://www.alibaba.com/product-detail/New-design-pen-style-electronic-cigarette_1804572170.html.

E-cigarette blister ego ce4 lx ego battery/1x ce4 clearomizer/1x oil bottle/1x usb charger wholesale, Vaporcity, 2016, http://www.dhgate.com/store/product/e-cigarette-blister-ego-ce4-1x-ego-battery/159864136.html.

International Preliminary Report for corresponding International Application No. PCT/US2016/027200 dated Oct. 26, 2017.

Office Action for corresponding U.S. Appl. No. 29/561,548 dated Mar. 15, 2018.

Election of Species and Restriction Requirement for U.S. Appl. No. 29/561,578 dated Jul. 3, 2017.

Non-Final Office Action for U.S. Appl. No. 29/561,578 dated Sep. 25, 2017.

Notice of Allowance for U.S. Appl. No. 29/561,578 dated Apr. 5, 2018.

Election of Species and Restriction Requirement for U.S. Appl. No. 29/561,548 dated Jun. 30, 2017.

Non-Final Office Action for U.S. Appl. No. 29/561,548 dated Sep. 11, 2017.

Notice of Allowance for corresponding U.S. Appl. No. 29/561,578 dated Jun. 22, 2018.

* cited by examiner

DISPLAY PACKAGES, BLANKS FOR FORMING TRAP SEAL CARD AND BLANK FOR FORMING DISPLAY BOX

BACKGROUND

1. Field

Example embodiments relate to display packages, blanks for forming a trap seal card and/or blanks for forming a display box.

2. Description of the Related Art

Display packages for electronic vapor devices are typically displayed on racks that accommodate display packages having a set maximum length and a set maximum width, placing constraints of the size of the display packages. Electronic vapor devices are generally packaged to include at least a cartomizer, a battery section and a universal serial bus (USB) charger. Features (e.g., smell and taste) of the cartomizer can be sensitive to external factors. In certain instances, it is desirable that the display packaging allow some, or all, items of the electronic vapor device to be visible to a consumer from outside of the display packaging, and/or allow easy access to some of the items. All of these factors must be taken into consideration when manufacturing the display packages, for electronic vapor devices, having size constraints.

SUMMARY

Some example embodiments provide display packages, blanks for forming a trap seal card and/or blanks for forming a display box.

According to some example embodiments, a display package includes at least one packaging including a cavity for holding an item, and a trap seal card including a first opening, the trap seal card retaining the at least one packaging such that the item to be held within the cavity is visible to a consumer through the first opening, and a portion of the at least one packaging protrudes through the first opening. The trap seal card includes a front panel integral with a back panel. The at least one packaging is interposed between the front panel and the back panel.

The at least one packaging may be transparent or translucent. The at least one packaging may further include a lidding covering at least the cavity, and the lidding may be formed of aluminum or paperboard.

The front panel may include the first opening, the back panel may include a second opening. The at least one packaging may be affixed to the back panel such that the lidding covering at least the cavity overlaps with the second opening.

The at least one packaging may be formed of a thermoplastic material.

The front panel may include the first opening. A first packaging may include a first compartment, the first compartment protruding through the first opening such that a first item to be held within the first compartment would be visible to the consumer through the first opening. A second packaging may include a second compartment, the second compartment protruding through the first opening such that a second item to be held within the second compartment would be visible to the consumer through the first opening.

The first compartment may be configured to hold a cartomizer of an electronic vapor device. The second compartment may be configured to hold a battery section of the electronic vapor device.

The front panel may further include a second opening, and the second packaging may include a third compartment, the third compartment protruding through the second opening such that a third item to be held within the third compartment would visible to the consumer through the second opening.

The third compartment may be configured to hold a universal serial bus charger.

The front panel may consist essentially of, or consist of, a first panel including the first opening, and second, third and fourth panels, collectively, forming a third compartment in conjunction with the back panel. The third compartment may protrude from a surface of the back panel.

The fourth panel may be attached to the back panel. The fourth panel may include a first tab and the back panel includes a second tab, the second tab being attached to the first tab along a first fold line. The first and second tabs may extend within the third compartment to collectively form a substantially 90-degree angle when folded along the first fold line.

The display package may further include an outer box holding the at least one packaging and the trap seal card. The outer box may be transparent or translucent. The outer box may be formed of at least one selected from poly(ethylene terephthalate) (PET) and amorphous PET.

According to other example embodiments, a blank for forming a trap seal card, includes a front panel attached to a back panel along a first fold line, the front and back panels including first and second opening, respectively, a portion of the back panel forming a first tab attached to a remaining portion of the back panel along a second fold line. The back panel or the front panel has a first length and a second length less than the first length, the first and second lengths extending in a substantially perpendicular direction to the first fold line.

The front panel may fold over the back panel such that the first opening overlaps with the second opening and the first tab.

The front panel may include a first panel including the first opening, and second, third and fourth panels, sequentially, interposed between the front panel and the back panel. The fourth panel may include a second tab and the back panel may include a third tab, the second tab being attached to the first tab along the first fold line.

A corner edge of the back panel may include a recess.

The back panel may include a second tab, and the front panel may include a recess, the recess being aligned with the second tab along a same axis as the first fold line.

According to further example embodiments, a blank for forming a display box includes a front panel and a back panel attached to a first side panel along first and second fold lines, respectively; a first top panel, a first bottom panel and a second side panel attached to the front panel along third, fourth and fifth fold lines, respectively; and a second top panel, a second bottom panel and a third side panel attached to the back panel along sixth, seventh and eighth fold lines, respectively. A portion of the back panel forms a tab, the tab being defined by a ninth fold line extending from one side of the sixth fold line to another side of the sixth fold line. The tab is detachable from a remaining portion of the back panel when the back panel is separated along the ninth fold line.

The tab may be attached to the second top panel along the sixth fold line, and the tab may remain attached to the second top panel when the back panel is separated.

The ninth fold line may have a parabolic shape.

BRIEF DESCRIPTION OF THE DRAWINGS

Example embodiments will be more clearly understood from the following detailed description taken in conjunction with the accompanying drawings. FIGS. 1 to 8C represent non-limiting, example embodiments as described herein.

FIG. 1 illustrates a display package according to an example embodiment,

FIGS. 4 and 5A-5C are perspective, front, rear and top views illustrating a display package according to other example embodiments, FIG. 6 is a front view illustrating a blank for forming a trap seal card according to other example embodiments, FIGS. 8A-8C are perspective, front and back views illustrating a panel insert according to some example embodiments.

DESCRIPTION OF EXAMPLE EMBODIMENTS

Figure 1:
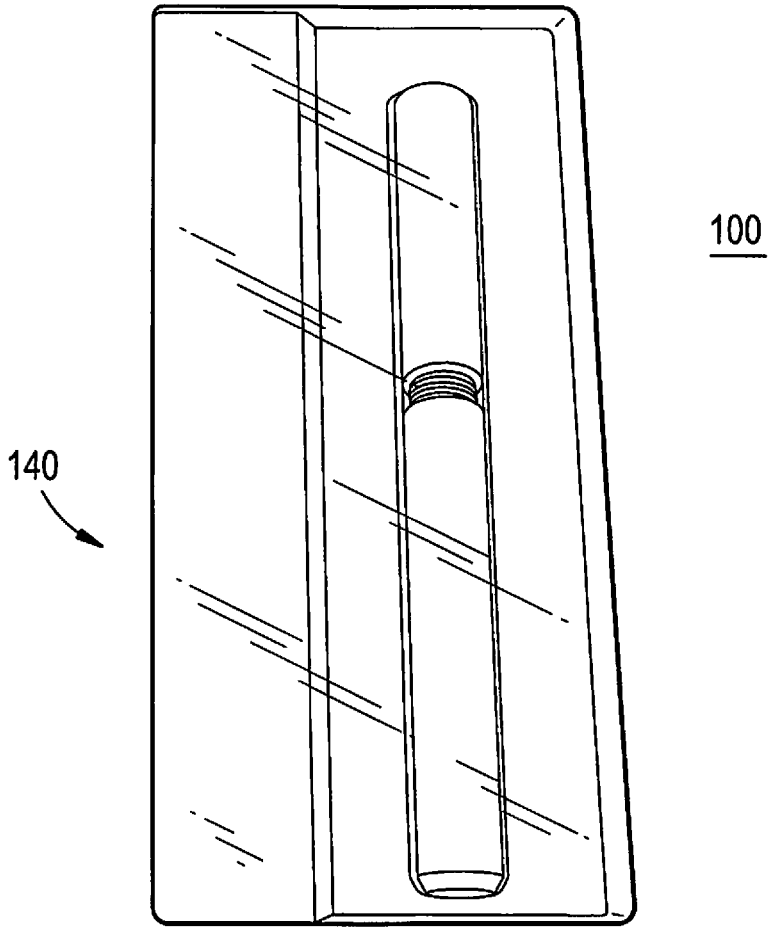

Various example embodiments will now be described more fully with reference to the accompanying drawings in which some example embodiments are shown. However, specific structural and functional details disclosed herein are merely representative for purposes of describing example embodiments. Thus, the invention may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope.

In the drawings, the thicknesses of layers and regions may be exaggerated for clarity, and like numbers refer to like elements throughout the description of the figures.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. For example, a region illustrated as a rectangle may have rounded or curved features. Thus, the regions illustrated in the figures are schematic in nature and their shapes do not necessarily illustrate the actual shape of a region of a component and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Although corresponding plan views and/or perspective views of some cross-sectional view(s) may not be shown, the cross-sectional view(s) of device structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In order to more specifically describe example embodiments, various features will be described in detail with reference to the attached drawings. However, example embodiments described are not limited thereto.

Some example embodiments provide display packages, blanks for forming a trap seal card and/or blanks for forming a display box.

Figure 2C:
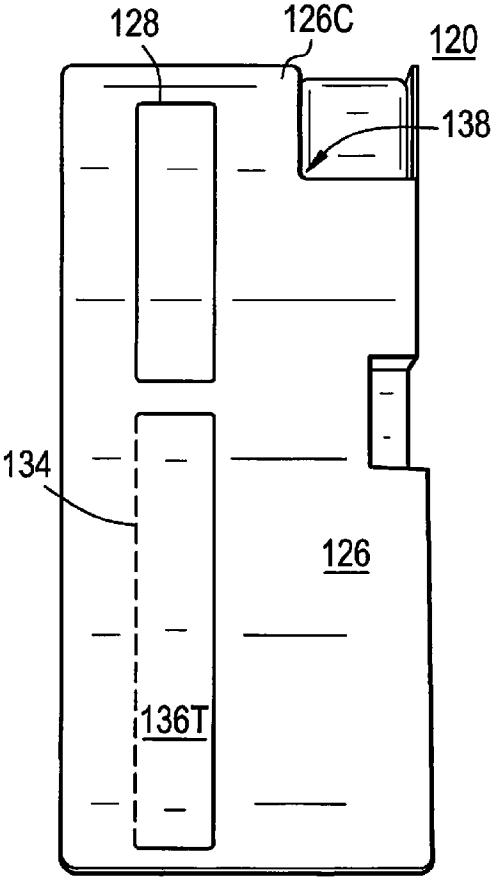
FIG. 2C illustrates a rear view of the trap seal card according to an example embodiment.

Some example embodiments of the display package, trap seal card and associated packaging will be described with respect to FIGS. 1-2E. FIG. 1 illustrates a display package according to an example embodiment, FIG. 2A illustrates packaging in the display package of FIG. 1 according to an example embodiment, FIG. 2B illustrates a front view of a trap seal card holding the packaging of FIG. 2A according to an example embodiment, FIG. 2C illustrates a rear view of the trap seal card according to an example embodiment, FIG. 2D illustrates a top view of the trap seal card according to an example embodiment, and FIG. 2E illustrates a rear perspective view of a portion of the packaging in FIG. 2A.

Figure 2B:
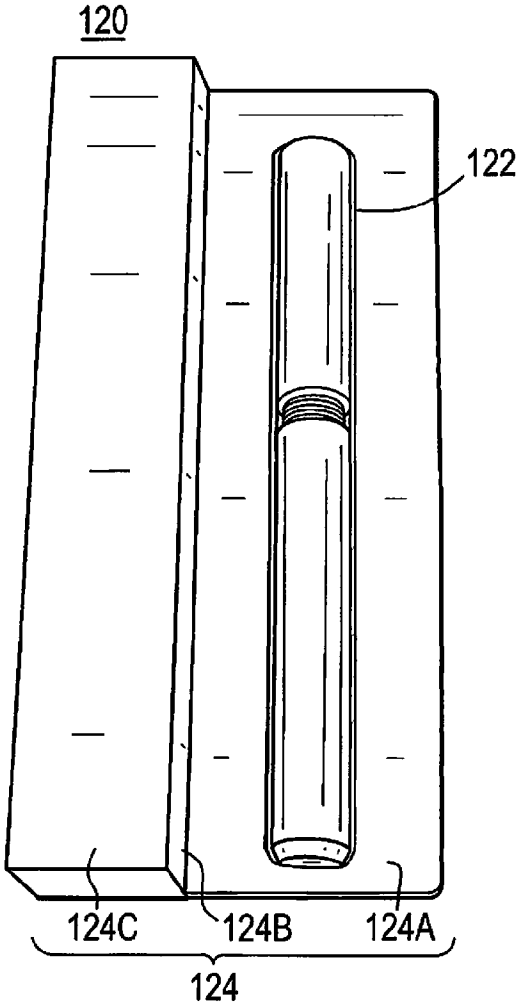
FIG. 2B illustrates a front view of a trap seal card holding the packaging of FIG. 2A according to an example embodiment.
Figure 2A:
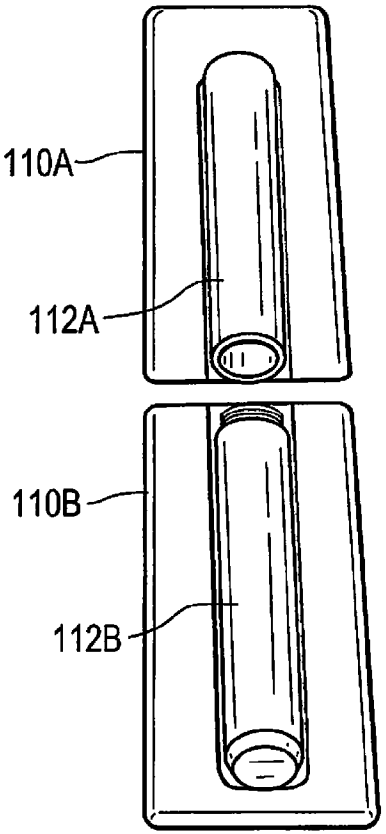
FIG. 2A illustrates packaging in the display package of FIG. 1 according to an example embodiment.
Figure 2D:
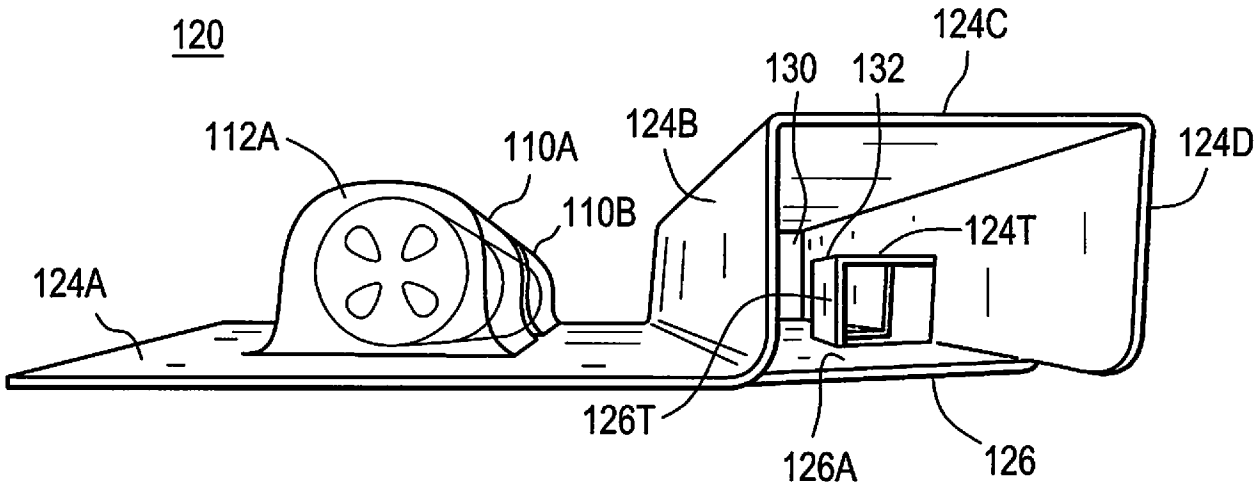
FIG. 2D illustrates a top view of the trap seal card according to an example embodiment.
Figure 2E:
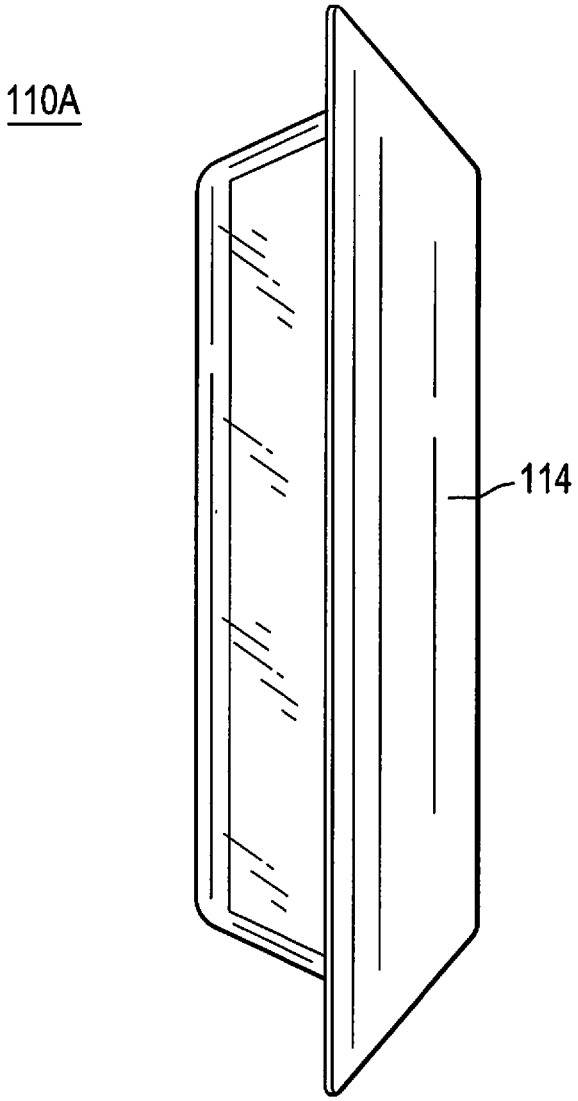
FIG. 2E illustrates a rear perspective view of a portion of the packaging in FIG. 2A, FIGS. 3A-3B are perspective and front views illustrating a blank for forming a trap seal card according to some example embodiments.

Referring to FIGS. 1-2B, a display package 100 includes at least one packaging 110A/110B including a cavity 112A/112B for holding an item, and a trap seal card 120 including a first opening 122. The packaging 110A/110B may be separate elements or conjoined elements. The trap seal card 120 retains the at least one packaging 110A/110B between a front panel 124 and a back panel 126 such that the item to be held within the cavity is visible to a consumer through the first opening 122. Namely, a portion of the at least one packaging 110A/110B protrudes through the first opening 122. The trap seal card 120 includes the front panel 124 integral with the back panel 126. The at least one packaging 110A/110B is interposed between the front panel 124 and the back panel 126. The at least one packaging 110A/110B may be interposed between the front panel 124 and the back panel 126 such that horizontal and vertical movement of the at least one packaging 110A/110B is substantially prevented by the portions of the least one packaging 110A/110B protruding through the first opening 122, in conjunction with an adhesive applied to the least one packaging 110A/110B. The front panel 124 may be attached to the back panel 126 by heat sealing.

The at least one packaging 110A/110B may be transparent or translucent. The at least one packaging 110A/110B may be formed of a thermoplastic material, paper, metal or combinations thereof. The at least one packaging 110A/110B may be formed of at least one selected from PVC, PVdC, PP, PET and PE. The at least one packaging 110A/110B may have a thickness of about 12-15 points. The at least one packaging 110A/110B may have a thickness of about 15 points. According to some example embodiments, a clear, poly-chloro-tri-fluoro-ethylene (PCTFE) film may be applied to the PVC, PVdC, PP, PET and PE. The cavity 112A/112B of the at least one packaging 110A/110B may have a semi-rigid form that is sufficiently collapsible so as to allow the item to be able to be removed from the display packing by manually applying pressure to the item.

The at least one packaging 110A/110B may further include a lidding 114 (see FIG. 2E) covering at least the cavity 112A/112B. The lidding 114 may be formed of aluminum and/or paper. The paper may be a single or multi-ply paper-based material having a thickness of about 0.001-inches. The lidding 114 have a heat seal coating that bonds the lidding 114 to the at least one packaging 110A/110B. The lidding 114 may be a push-through lidding, a peelable lidding, a peel-push lidding, and/or a tear-open lidding. The lidding 114 may have child resistant options. The lidding 114 may be broken by pressing on the cavity 112A/112B holding the item.

The at least one packaging 110A/110B including the lidding 114 may be a blister pack. The term "blister pack" as used herein refers to a pre-formed plastic packaging having at least one cavity for holding an item. The blister pack can protect items against external factors, such as humidity and contamination, and/or preserve internal qualities, such as aromas and flavors. The blister pack may be an opaque blister pack that protects light-sensitive items from ultra-violet rays. The blister pack may be formed of PVC with a thickness of about 0.010-inches.

Referring to FIGS. 2B-2D, the trap seal card 120 may be formed of cardboard, paperboard (e.g., solid bleached board (SBB) or solid bleached sulphate (SBS) board), any thick paper-based material (e.g., folding boxboard, chipboard or laminated board), plastic, metal or combinations thereof. The trap seal card 120 may be formed of a coated, heat-sealable paperboard. The paperboard may have a thickness of about 12 points. However, example embodiments are not limited thereto. The paperboard can be single- or multi-ply. The front panel 124 may include the first opening 122. The back panel 126 may include a second opening 128. The at least one packaging 110A is affixed to the back panel 126 using an adhesive such that the lidding 114 covering at least the cavity 112A overlaps with the second opening 128. The item held in the cavity 112A may be removed from the cavity 112A though the second opening 128 (see FIG. 2C).

Surfaces of the trap seal card 120 may be printed, embossed, debossed or embellished with a manufacturer or brand logo, a trademark, consumer information and/or indicia.

A portion of the back panel 126 forms a tab 136T attached to a remaining portion of the back panel 126 along a fold line 134. The tab 136T may be positioned below the second opening 128.

According to example embodiments, the display packaging 100 may include a first packaging 110A including a first compartment/cavity 112A. The first compartment 112A protrudes through the first opening 122 such that a first item to be held within the first compartment 112A would be visible to the consumer through the first opening 122. The display packaging may include a second packaging 110B including a second compartment/cavity 112B. The second compartment 1108 protrudes through the first opening 122 such that a second item to be held within the second compartment 112B would be visible to the consumer through the first opening 122. The first and second packaging 110A and 110B may be formed separate from each other. The first and second packaging 110A and 110B may be attached to each other using an adhesive. However, example embodiments are not limited thereto. That is, the first packaging 110A may be integral with the second packaging 110B.

The first compartment 112A may be configured to hold a cartomizer of an electronic vapor device, and the second compartment 112B may be configured to hold a battery section of an electronic vapor device. Because the cartomizer is sensitive to smell and taste, the first packaging 110A may be a blister pack to preserve qualities of the cartomizer.

Referring to FIGS. 2B and 2D, the front panel 124 may include, or consist essentially, of a first panel 124A including the first opening 122, and second, third and fourth panels 124B/C/D, collectively, forming a third compartment 130 in conjunction with the back panel 126. The third compartment 130 protrudes from a surface 126A of the back panel 126.

The fourth panel 124D is attached to the back panel 126. The fourth panel 124D includes a first tab 124T, and the back panel 126 includes a second tab 126T. The second tab 126T is attached to the first tab 124T along a fold line 132. The first and second tabs 124T/126T extend within the third compartment 130 to collectively form a substantially 90-degree angle when folded along the fold line 132.

The third compartment 130 may be configured to hold a universal serial bus (USB) charger. The USB charger may rest on top or upper, surfaces of the first and second tabs 124T/126T. The position of the first and second tabs 124T/126T may allow for an upper surface of the USB charger to be even with an upper surface of the trap seal card 120.

Referring to FIG. 2C, a top corner edge 126C of the back panel 126 may include a recess 138 separating the top corner edge 126C from the front panel 124 along the fold line 232. A length of the recess 138 may be substantially equal to a length of the third compartment 130. The recess 138 allows the consumer to easily remove the item held within the third compartment 130.

Referring to FIG. 1, the display package 100 may further include an outer box 140 holding the at least one packaging 110A/B and the trap seal card 120. The outer box 140 may be transparent or translucent. The outer box 140 may be formed of at least one selected from polyethylene terephthalate) (PET) and amorphous PET. The outer box 140 may be formed of a material having a thickness of about 14 pt. The outer box 140 may have a maximum height of about 118-mm, a maximum length of about 55-mm, and a width of about 15-mm to 17-mm. The overall size of the outer box 140 allows the display packaging 100 to fit typical selling racks.

Inner or outer surfaces of the outer box 140 may be printed, embossed, debossed or embellished with a manufacturer or brand logo, a trademark, consumer information and/or indicia.

Figure 3B:
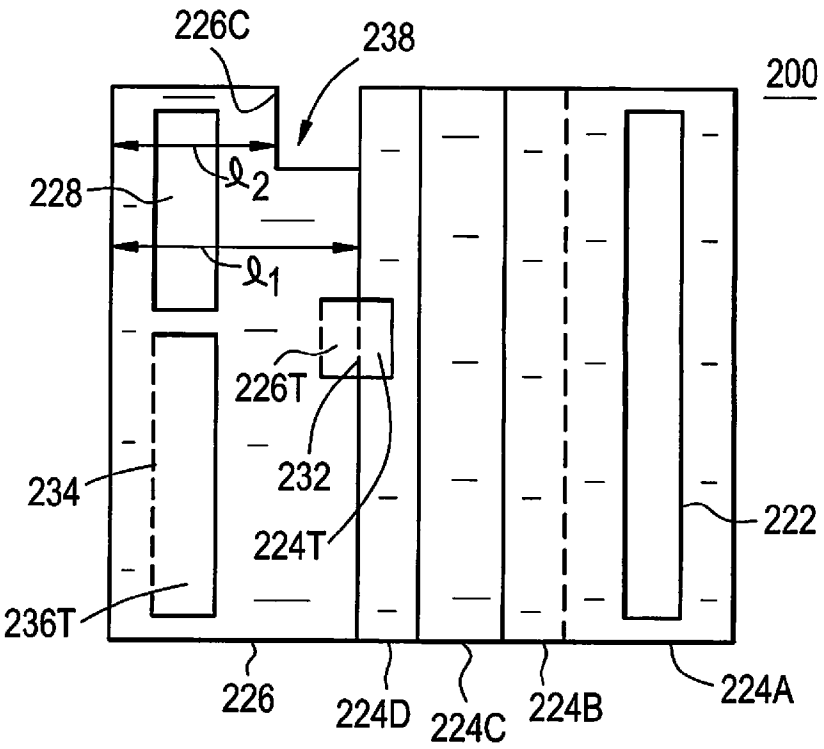
Figure 3A:
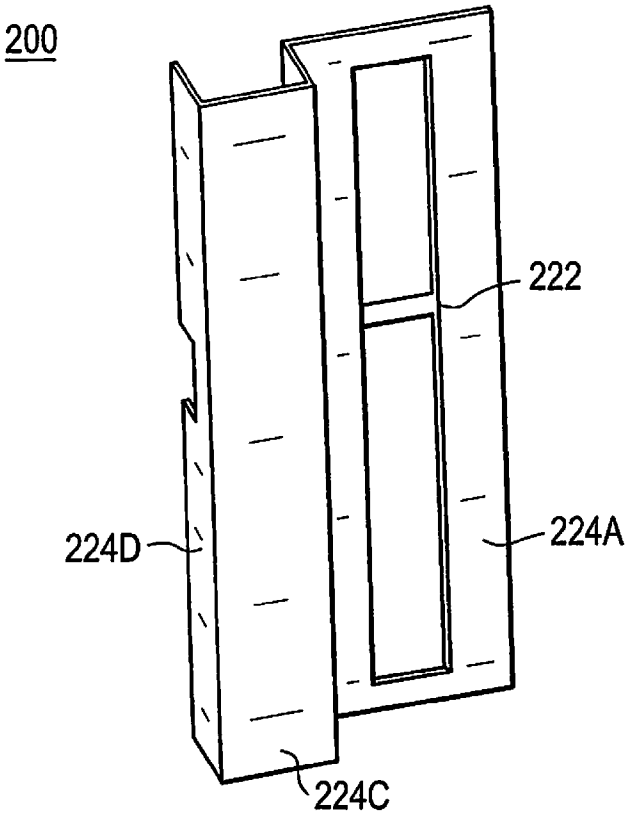
Figure 4:
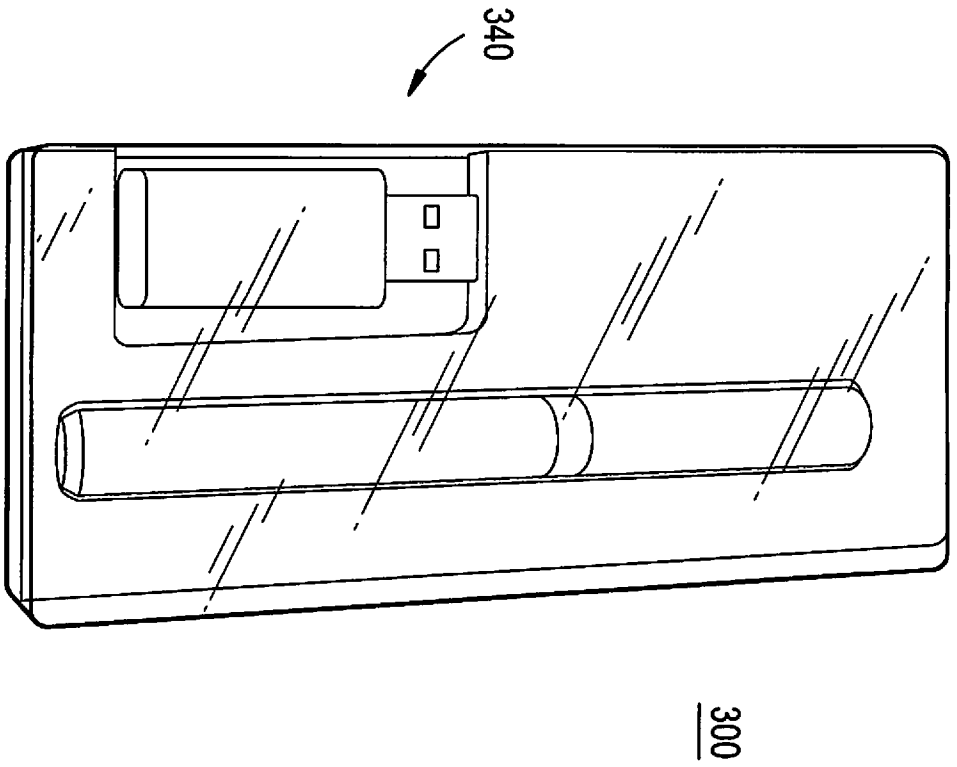
Figure 5C:
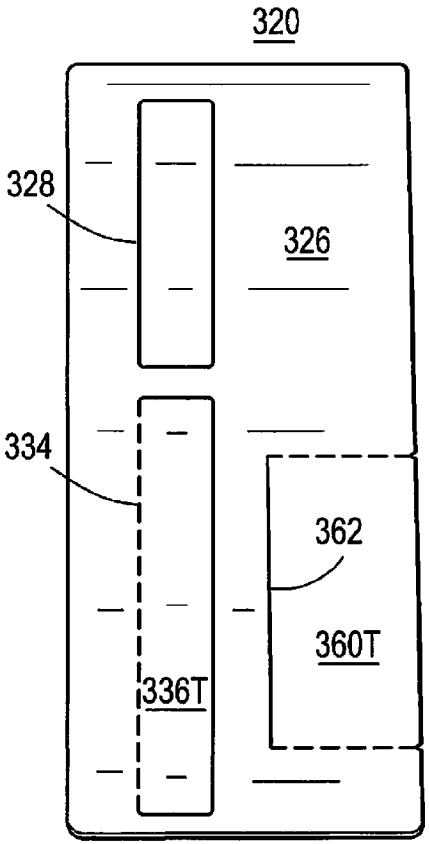
Figure 5B:
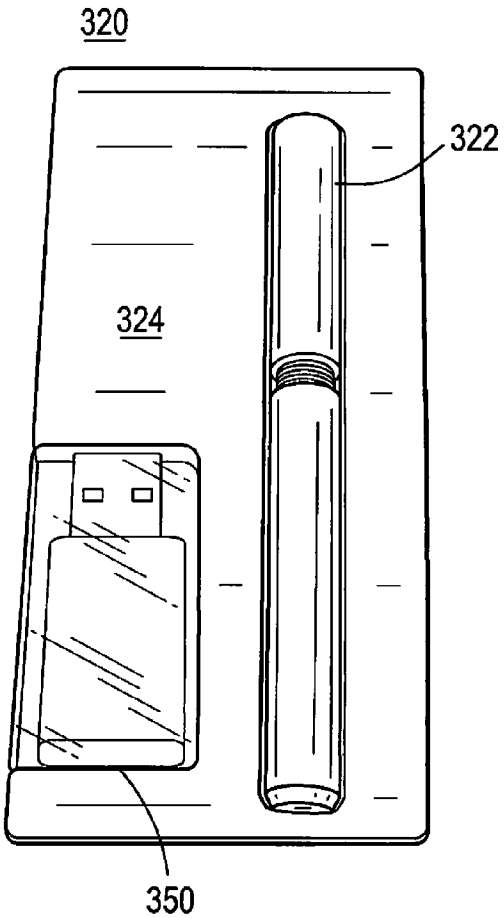
Figure 5A:
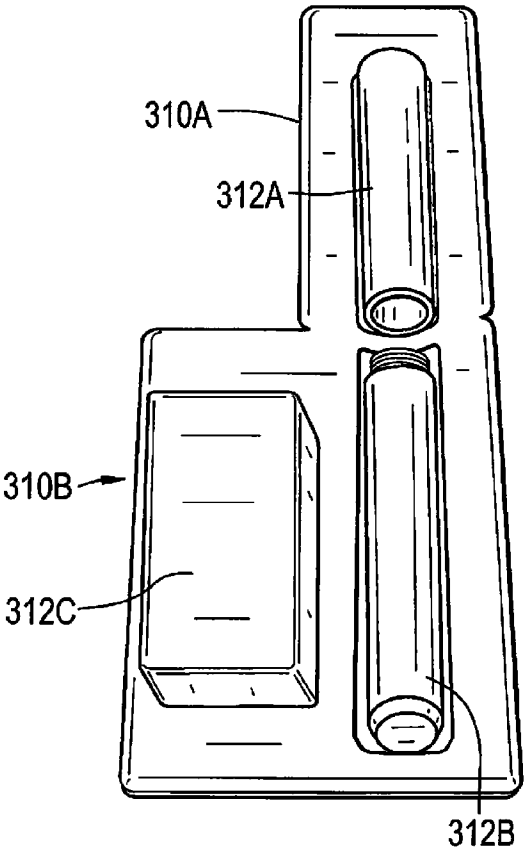

FIGS. 3A-3B are perspective and front views illustrating a blank for forming a trap seal card according to some example embodiments.

Referring to FIGS. 3A-3D, a blank 200 for forming a trap seal card includes a front panel 224 attached to a back panel 226 along a fold line 232. The front panel 224 includes a first opening 222, and the back panel 226 includes a second opening 228. A portion of the back panel 226 forms a tab 236T attached to a remaining portion of the back panel 226 along a fold line 234. The back panel 226 has a first length L1, and a second length L2 less than the first length L1. The first and second lengths L1 and L2 extend in a substantially perpendicular direction (along x-axis) to an extending direction (along y-axis) of the fold line 232. When the front panel 224 is folded over the back panel 226, the first opening 222 overlaps with the second opening 228 and the tab 236T.

The front panel 224 includes a first panel 224A including the first opening 222, and second, third and fourth panels 224B/C/D, sequentially, interposed between the front panel 224 and the back panel 226. The fourth panel 224D includes a tab 224T, and the back panel 226 includes a tab 226T. The tab 224T is attached to the tab 226T along the fold line 232.

A top corner edge 226C of the back panel 226 along the fold line 232 may include a recess 238 separating the top corner edge 226C from the front panel 124 along the fold line 232. A length of the recess 238 may be substantially equal to a length of the third panel 224C.

The blank 200 has a maximum height of about 118-mm, a maximum length of about 55-mm, and a width of about 15-mm to 17-mm.

FIGS. 4 and 5A-5C are perspective, front, rear and top views illustrating a display package according to other example embodiments.

Elements in FIGS. 4 and 5A-5C that are similar to, or like, elements in FIGS. 1-2E include similar reference numerals. A description of elements in FIGS. 4 and 5A-5C that are similar to, or like, elements in FIGS. 1-2E is omitted for the sake of brevity.

Referring to FIGS. 4 and 5A-5C, a display package 300 includes at least one packaging 310A/310B including at least one cavity 312A/312B/312C for holding an item, and a trap seal card 320 including a first opening 322. The trap seal card 320 retains the at least one packaging 310A/310B such that the item to be held within the cavity is visible to a consumer through the first opening 322. A portion of the at least one packaging 310A/310B protrudes through the first opening 322. The trap seal card 320 including a front panel 324 is integral with a back panel 326. The at least one packaging 310A/310B is interposed between the front panel 324 and the back panel 326.

The at least one packaging 310A/310B may further include a lidding (see lidding 114 in FIG. 2E) covering at least the cavity 312A/312B/312C. The lidding may be formed of aluminum or paperboard. The lidding may be a push-through lidding, a peelable lidding, a peel-push lidding, and/or a tear-open lidding. The lidding may have child resistant options. The lidding may be broken by pressing the item held within the cavity 312A/312B/312C. The at least one packaging 310A/310B/310C including the lidding may be a blister pack.

The front panel 324 may include the first opening 322. The back panel 326 may include a second opening 328. The at least one packaging 310A is affixed to the back panel 326 using an adhesive such that the lidding covering at least the cavity 312A overlaps with the second opening 328.

A first portion of the back panel 326 may form a tab 336T attached to a remaining portion of the back panel 326 along a fold line 334. The tab 336T may be positioned below the second opening 128. The at least one packaging 310B is affixed to the back panel 326 using an adhesive such that the cavity 312B overlaps with the tab 336T.

A second portion of the back panel 326 may form a tab 360T attached to the remaining portion of the back panel 326 along a fold line 362. The tab 360T may be positioned directly adjacent to the front panel 324. The at least one packaging 310B is affixed to the back panel 326 using an adhesive such that the cavity 312C overlaps with the tab 360T.

The front panel 324 may further include a third opening 350. A portion of the at least one packaging 310B protrudes through the third opening 350.

According to example embodiments, the display packaging 300 may include a first packaging 310A including a first compartment/cavity 312A. The first compartment 312A protrudes through the first opening 322 such that a first item to be held within the first compartment 312A would be visible to the consumer through the first opening 322. The display packaging may include a second packaging 310B including a second compartment/cavity 312B. The second compartment 310B protrudes through the first opening 322 such that a second item to be held within the second compartment 312B would be visible to the consumer through the first opening 322. The first and second packaging 310A and 310B may be formed separate from each other. However, example embodiments are not limited thereto. That is, the first packaging 310A may be integral with the second packaging 310B.

The first compartment 312A may be configured to hold a cartomizer of an electronic vapor device, and the second compartment 312B may be configured to hold a battery section of an electronic vapor device. Because the cartomizer is sensitive to smell and taste, the first packaging 310A may be a blister pack to preserve qualities of the cartomizer.

The second packaging 310B further includes a third compartment 312C. The third compartment 312C protrudes through the third opening 350 such that a third item to be held within the third compartment 312C would visible to the consumer through the third opening 350.

The third compartment 312C may be configured to hold a USB charger.

The display package 300 may further include an outer box 340 holding the at least one packaging 310A/310B and the trap seal card 320. The outer box 340 may be transparent or translucent. The outer box 340 may be formed of at least one selected from poly(ethylene terephthalate) (PET) and amorphous PET. The outer box 340 may have a maximum height of about 118-mm, a maximum length of about 55-mm, and a width of about 15-mm to 17-mm. The overall size of the outer box 340 allows the display packaging 300 to fit typical selling racks.

Figure 6:
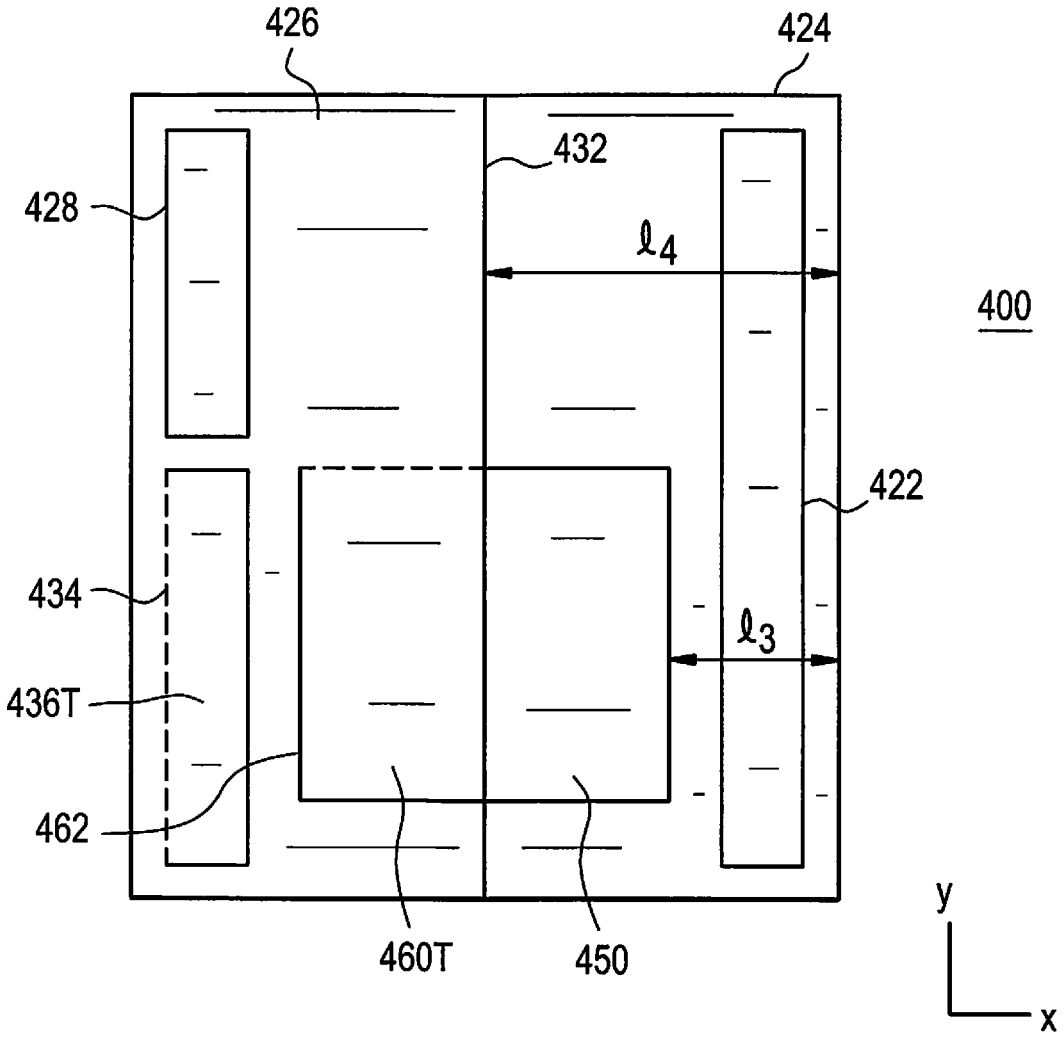

FIG. 6 is a front view illustrating a blank for forming a trap seal card according to other example embodiments.

Referring to FIG. 6, a blank 400 for forming a trap seal card includes a front panel 424 attached to a back panel 426 along a fold line 432. The front panel 424 includes a first opening 422, and the back panel 426 includes a second opening 428. A first portion of the back panel 426 forms a tab 436T attached to a remaining portion of the back panel 426 along a fold line 434. The tab 436T may be positioned below the second opening 428. The front panel 426 has a first length L3, and a second length L4 less than the first length L3. The first and second lengths L3 and L3 extend in a substantially perpendicular direction (along x-axis) to an extending direction (along y-axis) of the fold line 432. When the front panel 424 is folded over the back panel 426, the first opening 422 overlaps with the second opening 428 and the tab 436T.

A second portion of the back panel 426 forms a tab 460T attached to a remaining portion of the back panel 426 along a fold line 462. The tab 460T may be positioned directly adjacent to the front panel 424.

The front panel 424 includes a recess 450, the recess 450 being aligned with the tab 460T along a same axis as the fold line 422.

The blank 400 has a maximum height of about 118-mm, a maximum length of about 55-mm, and a width of about 15-mm to 17-mm.

Figure 7B:
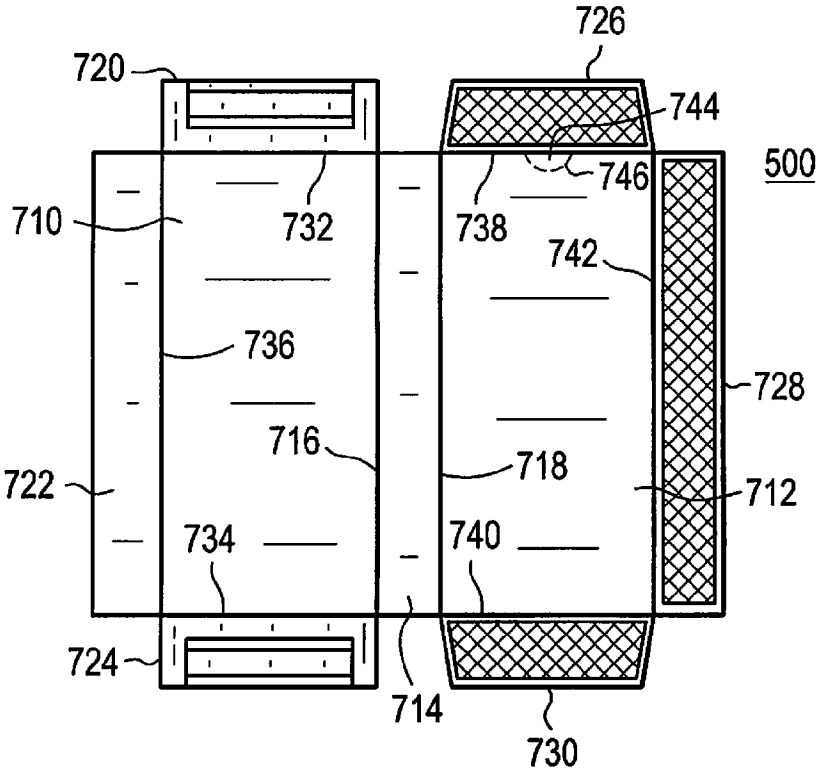
FIGS. 7A and 7B are perspective and front views illustrating a blank for forming a display box according to some example embodiments.
Figure 7A:
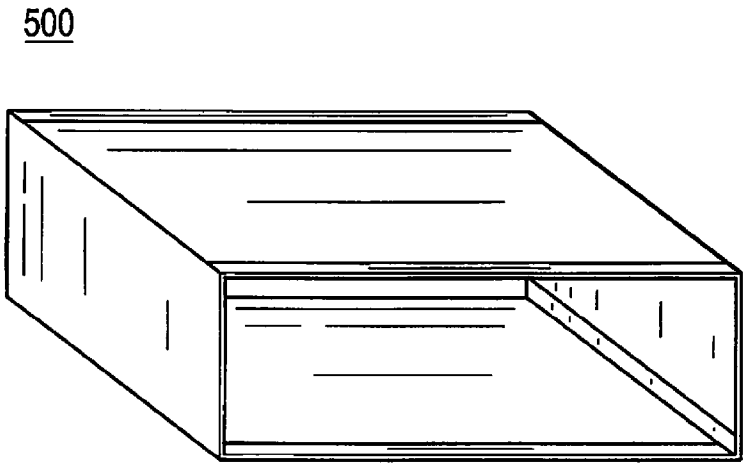

FIGS. 7A and 7B are perspective and front views illustrating a blank for forming a display box according to some example embodiments.

Referring to FIGS. 7A and 7B, a blank 700 for forming a display box includes a front panel 710 attached to a first side panel 714 along a first fold line 716, and a back panel 712 attached to the first side panel 714 along a second fold line 718. A first top panel 720, a first bottom panel 724 and a second side panel 722 are attached to the front panel 710 along a third fold line 732, a fourth fold line 734 and a fifth fold line 736, respectively. A second top panel 726, a second bottom panel 730 and a third side panel 728 are attached to the back panel 712 along a sixth fold line 738, a seventh fold line 740 and an eighth fold line 742, respectively.

Front sides of the second top panel 726, a second bottom panel 730 and a third side panel 728 may be varnish free areas. Pressure sensitive tape may be attached to the backside of the first top panel 720 and the first bottom panel 724 so that the first top panel 720 attaches to the second top panel 726 and the first bottom panel 724 attaches to the second bottom panel 730.

A portion of the back panel 712 forms a tab 744. The tab 744 being defined by a ninth fold line 746 extending from one side of the sixth fold line 738 to another side of the sixth fold line 738. Ninth fold line 746 may be a score, cut, or perforated, line that partially extends into the material so as to allow the first tab 744 to detach upon the application of force by the consumer. The first tab 744 is detachable from a remaining portion of the back panel 712 when the back panel 712 is separated along the ninth fold line 746.

The first tab 744 may be attached to the second top panel 726 along the sixth fold line 738. The first tab 744 remains attached to the second top panel 726 when the back panel 712 is separated along the ninth fold line 746.

The ninth fold line may have a parabolic shape. However, example embodiments are not limited thereto. That is, other shapes may be used that allow a consumer to grab the first tab 744 with ease.

The panels of the blank 700 may be glued together with a moisture-curable polyurethane hot melt or a technomelt.

According to example embodiments, other items such as a panel insert or coupon may be held within confines of the outer box, along with the trap seal card and the packaging(s).

The blank 700 may be provided in a folded and glued form. The blank 700 may be provided in a flatten state without being completely flattened.

The blank 700 may be erected by pre-breaking fold lines 716 and 718, folding fold lines 722 and 742 to substantially 180-degrees, and gluing the third side panel 728 to the second side panel 722.

Figure 8C:
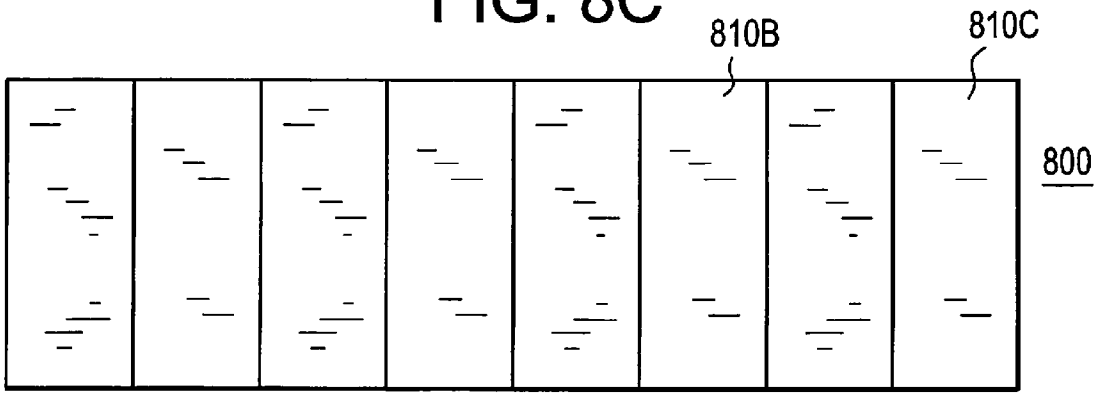
Figure 8B:
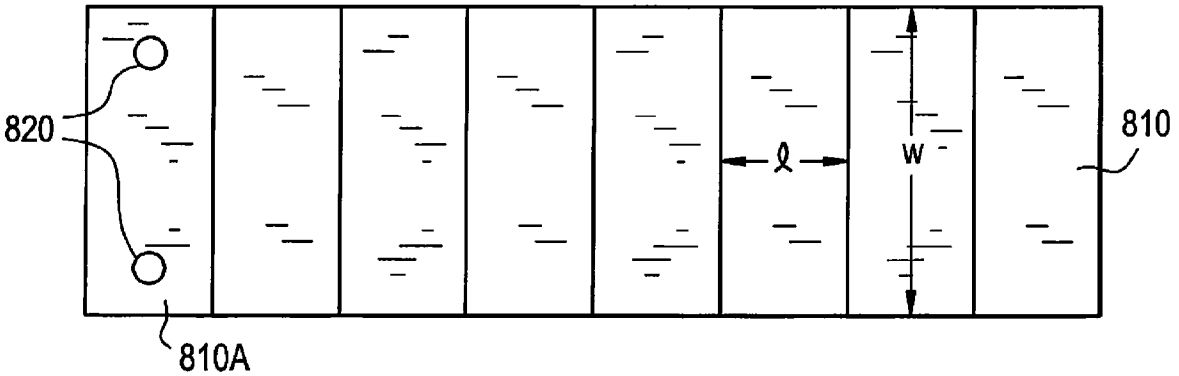
Figure 8A:
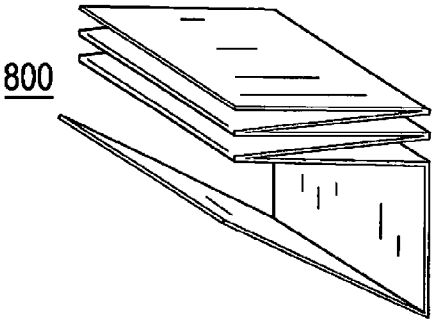

FIGS. 8A to 8C are perspective, front and back views illustrating a panel insert according to some example embodiments.

Referring to FIGS. 8A-8A, a panel insert 800 includes a single sheet of paper folded into a desired number of panels 810 (e.g., eight panels) arranged in series along a single row. The paper may be 80 pound C2S paper. The dimensions of each panel 810 are determined according to the dimensions of an outer box. According to some example embodiments, the panels 810 may each have a width (w) of about 115-mm and a length (l) of about 50-mm.

Some of the panels 810 (e.g., six panels) may be accordion folded, and some of the panels 810 (e.g., two panels) may be barrel folded. Dots 820 of an adhesive, such as fugitive glue, may be applied to a panel 810*a* on a front side of the panel insert 800. With the adhesive dots 820, the panel 810*a* may be attached to a panel 810*b* on a back side of the panel insert 800. One of the panels 810*c* on the back side of the panel insert 800 may be a cover panel that contains indicia visible to a consumer through an outer box.

The panel insert 800 may be provided in a folded or glued format for assembly.

In accordance with example embodiments, a fold line can be a substantially linear, although not necessarily straight, form that allows for folding. A fold line may include a score line, such as lines created with a sharp object that cause an indentation in a material, or a perforated line. Cut lines extend partially into or completely through a material.

The foregoing is illustrative of example embodiments and is not to be construed as limiting thereof. Although a few example embodiments have been described, those skilled in the art will readily appreciate that many modifications are possible in example embodiments without materially departing from the novel teachings. Accordingly, all such modifications are intended to be included within the scope of the disclosure as defined in the claims. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

What is claimed:

1. A display package, comprising:

a first packaging including a first compartment configured to hold a first item;

a second packaging including a second compartment configured to hold a second item; and a trap seal card including a first opening, the trap seal card retaining the first packaging and the second packaging such that the first item and the second item to be held within the first compartment and the second compartment are visible to a consumer through the first opening, and a portion of each of the first packaging and the second packaging protrudes through the first opening, the trap seal card including a front panel integral with a back panel, the front panel consisting essentially of, a first panel including the first opening, and second, third and fourth panels, collectively, forming a third compartment in conjunction with the back panel, the third compartment protruding from a surface of the back panel, and a portion of each of the first packaging and the second packaging being interposed between the front panel and the back panel.

2. The display package of claim 1, wherein at least one of the first packaging or the second packaging is one of transparent or translucent, and at least one of the first packaging or the second packaging further includes a lidding covering at least one of the first compartment or the second compartment, and the lidding is formed of one of aluminum or paperboard.

3. The display package of claim 2, wherein the front panel includes the first opening, the back panel includes a second opening, and at least one of the first packaging or the second packaging is affixed to the back panel such that the lidding covering at least the cavity overlaps with the second opening.

4. The display package of claim 1, wherein at least one of the first packaging or the second packaging is formed of a thermoplastic material.

5. The display package of claim 1, wherein the first compartment is configured to hold a cartomizer of an electronic vapor device, and the second compartment is configured to hold a power supply section of the electronic vapor device.

6. The display package of claim 1, wherein the fourth panel is attached to the back panel, the fourth panel includes a first tab and the back panel includes a second tab, the second tab being attached to the first tab along a first fold line, and the first and second tabs extending within the third compartment to collectively form a substantially 90-degree angle when folded along the first fold line.

7. The display package of claim 1, further comprising:

an outer box configured to hold the first packaging, the second packaging and the trap seal card, the outer box being one of transparent or translucent.

8. The display package of claim 7, wherein the outer box is formed of at least one selected from poly(ethylene terephthalate) and amorphous poly(ethylene terephthalate).

* * * * *